US010328470B2

(12) United States Patent
Thomas et al.

(10) Patent No.: US 10,328,470 B2
(45) Date of Patent: Jun. 25, 2019

(54) ROLL DIMPLER APPARATUS AND METHOD FOR PREPARING METAL BLANKS

(71) Applicants: Timothy Thomas, St Clair Shores, MI (US); Sean Murphy, Sterling Heights, MI (US); Douglas Holt, Canton, MI (US)

(72) Inventors: Timothy Thomas, St Clair Shores, MI (US); Sean Murphy, Sterling Heights, MI (US); Douglas Holt, Canton, MI (US)

(73) Assignee: Welker Engineered Products, Troy, MI (US)

( * ) Notice: Subject to any disclaimer, the term of this patent is extended or adjusted under 35 U.S.C. 154(b) by 500 days.

(21) Appl. No.: 15/083,219

(22) Filed: Mar. 28, 2016

(65) Prior Publication Data

US 2016/0279687 A1 Sep. 29, 2016

Related U.S. Application Data

(60) Provisional application No. 62/139,177, filed on Mar. 27, 2015.

(51) Int. Cl.

| | |
|---|---|
| ***B21B 1/22*** | (2006.01) |
| ***B21B 37/16*** | (2006.01) |
| ***B21H 8/00*** | (2006.01) |
| ***B21D 22/04*** | (2006.01) |
| *B21D 13/04* | (2006.01) |

(52) U.S. Cl.

CPC ..... *B21B 1/222* (2013.01); *B21B 37/16* (2013.01); *B21D 22/04* (2013.01); *B21H 8/005* (2013.01); *B21D 13/04* (2013.01)

(58) Field of Classification Search

CPC ..... B21D 13/04; B21D 22/04; B21D 17/04; B21D 17/00; B21D 28/04; B21D 28/26; B21D 28/265; B21D 28/36; B21D 5/08; B44B 5/00; B44B 5/0004; B44B 5/0009; B21H 8/005; B21B 37/16; B65H 20/02

See application file for complete search history.

(56) References Cited

U.S. PATENT DOCUMENTS

| | | | | | |
|---|---|---|---|---|---|
| 4,059,000 | A * | 11/1977 | Bodnar | B44B 5/0047 | 72/196 |
| 5,040,397 | A * | 8/1991 | Bodnar | B21D 28/36 | 72/190 |
| 5,673,585 | A * | 10/1997 | Bishop | B21D 22/04 | 72/404 |
| 8,459,087 | B2 * | 6/2013 | Konig | B21D 28/04 | 72/379.2 |
| 8,926,486 | B2 * | 1/2015 | Diehr | B31B 1/00 | 493/468 |
| 9,623,470 | B1 * | 4/2017 | Knockeart | B21D 22/04 | |
| 9,914,599 | B2 * | 3/2018 | Namuduri | B65G 59/04 | |
| 2017/0333969 | A1 * | 11/2017 | Oei | B44B 5/00 | |

* cited by examiner

*Primary Examiner* — Peter Dungba Vo
*Assistant Examiner* — Joshua D Anderson
(74) *Attorney, Agent, or Firm* — FisherBroyles, LLP

(57) ABSTRACT

A device and method of preparing metal blanks including applying a series of dimples in metal feed stock.

20 Claims, 6 Drawing Sheets

FIG 4A-A
FIG 4B-B
SECTION A-A
SCALE 1
SECTION B-B
SCALE 1

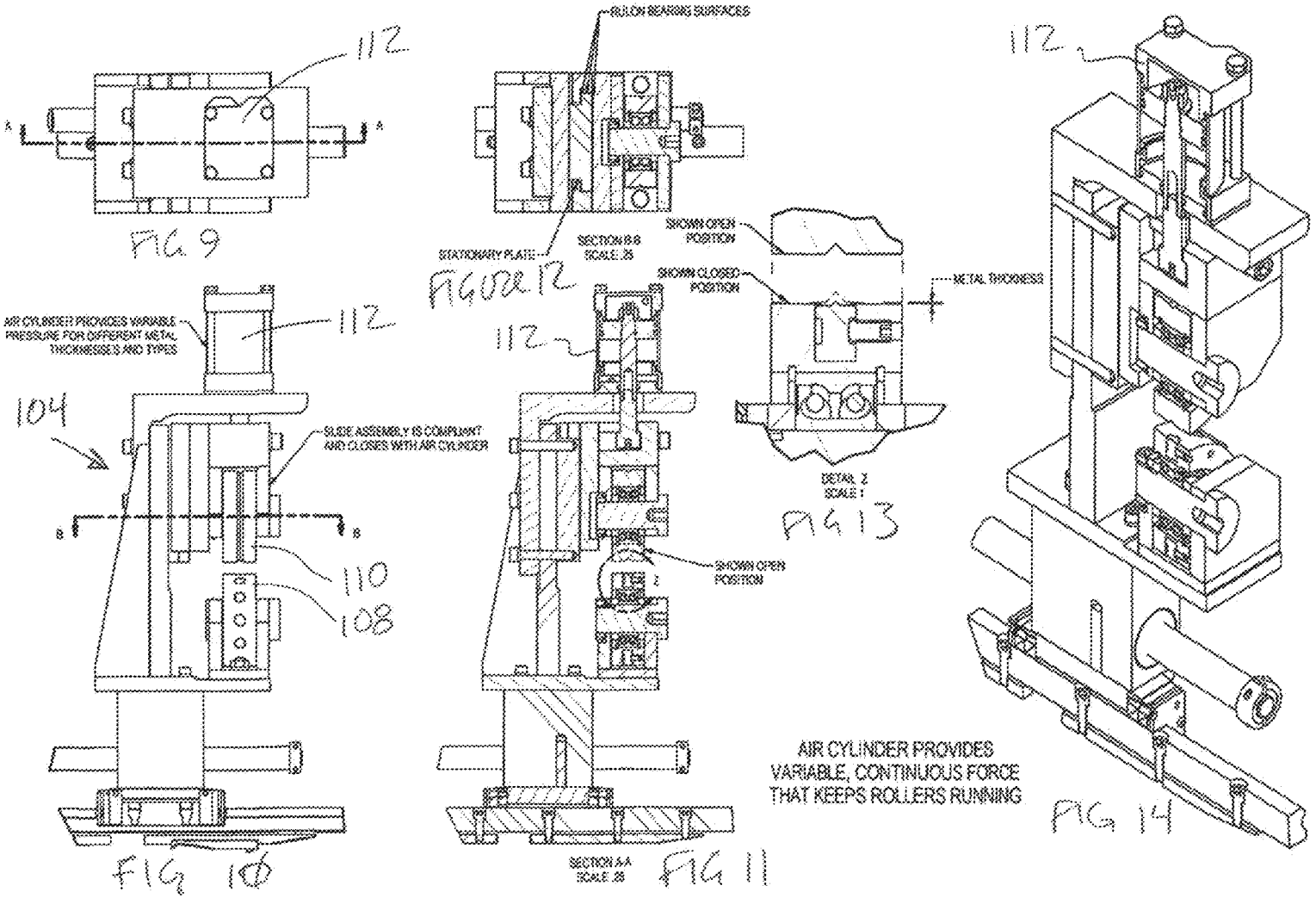
112
METAL THICKNESS
DETAIL 2
SCALE 1
FIG 13
FIG 14
AIR CYLINDER PROVIDES
VARIABLE, CONTINUOUS FORCE
THAT KEEPS ROLLERS RUNNING
ROLLER BEARING SURFACES
SHOWN OPEN POSITION
SHOWN CLOSED POSITION
SHOWN OPEN POSITION
SECTION B-B
SCALE 3
STATIONARY PLATE
FIGURE 12
112
SECTION A-A
SCALE 3
FIG 11
112
A
FIG 9
112
SLIDE ASSEMBLY IS COMPLIANT
AND CLOSES WITH AIR CYLINDER
1110
108
AIR CYLINDER PROVIDES VARIABLE
PRESSURE FOR DIFFERENT METAL
THICKNESSES AND TYPES
104
B
FIG 10

ROLL DIMPLER APPARATUS AND METHOD FOR PREPARING METAL BLANKS

This Application claims the benefit of U.S. Provisional Application Ser. No. 62/139,177 filed on Mar. 27, 2015.

SUMMARY

The need for the roll dimpler came about because of the increased use of aluminum stamped panels in automotive and other industries. Currently one line makes the blanks, stacks them, then sends them to the final stamping line. The blanks are stacked in specific pallets for transport. The pallets allow pneumatic suction cups to vertically lift then horizontally feed the blanks into the press. Steel blanks are usually separated by a device called a fanner magnet. This device magnetically lifts the top sheet and slides it sideways off the sheets below so that the vacuum cups can pick it up easily. The non-magnetic nature of aluminum created significant new problems in blank separation. Air knives and other traditional technologies were not sufficient to accomplish blank separation. Separation is important in the blanking process because double feeding a blank can severely damage the die and shut down a manufacturing line.

We produced an in-line dimpling device that would run right after the decoiler straightener before the blanks were cut in the blanking press die. The device would need to handle aluminum of different thicknesses and produce small dimples, for example, less than 10% of the material thickness. The dimples need only be sufficient in size and density to accomplish blank separation, usually 0.007" or less. In order to achieve this goal, we devised a system having two rollers under continuous but variable pressure with compliance to insure the dimpling members would continue to roll concentrically. Our initial device is powered by an air cylinder, but it could also be powered by a gas spring or coil spring. The pairs of rollers or "dimpling heads" are movable to accommodate different widths of coils.

Without the dimples, a stack of aluminum blanks are nearly impossible for a man to separate. With the dimples a man can move the top blank with only two fingers. In one test, the addition of 0.006" tall dimples with two inch spacing makes this dramatic change.

Our device used coordinated, opposed, male and female dimpling wheels derived from roll marking technology. The compliant features that allows the wheels to continue to roll concentrically are new. The use of filled teflon Gib sets in the compliance guide absorbs the very short linear travel without fretting or lubrication. The depth of the dimple is controlled by the pressure on the air cylinder combined with the height of the male dimple so that multiple aluminum metal thicknesses can be dimpled with the same unit. The dimpler also works on other nonferrous metals and steel blanks.

Once the device is set, one method of operation is as follows:

Retract the air cylinders to separate the dimpling wheels;
Feed new coil through opening in "dimpling head;"
Close dimpling head wheels;
Stamp at least 3 blanks and measure dimple height;
Adjust air pressure to achieve desired dimple height; and
Run blanks as normal.

BRIEF DESCRIPTION OF THE DRAWINGS

The accompanying drawings, which are incorporated in and constitute a part of the specification, illustrate various example systems, methods, and so on that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

FIG. 9 is a top elevational view of an exemplary dimpler head mechanism.

FIG. 10 is a front elevational view of the exemplary dimpler head mechanism of FIG. 9.

FIG. 11 is a cross-sectional view of the exemplary dimpler head mechanism of FIG. 9 taken along line A-A.

FIG. 12 is a cross-sectional view of the exemplary dimpler head mechanism of FIG. 10 taken along line B-B.

FIG. 13 is an enlarged detail of the wheels of FIG. 11 area Z showing the replaceable male dimple punch.

FIG. 14 is a perspective cross-sectional view of the dimpler head mechanism of FIG. 9.

DETAILED DESCRIPTION

Figure 1:
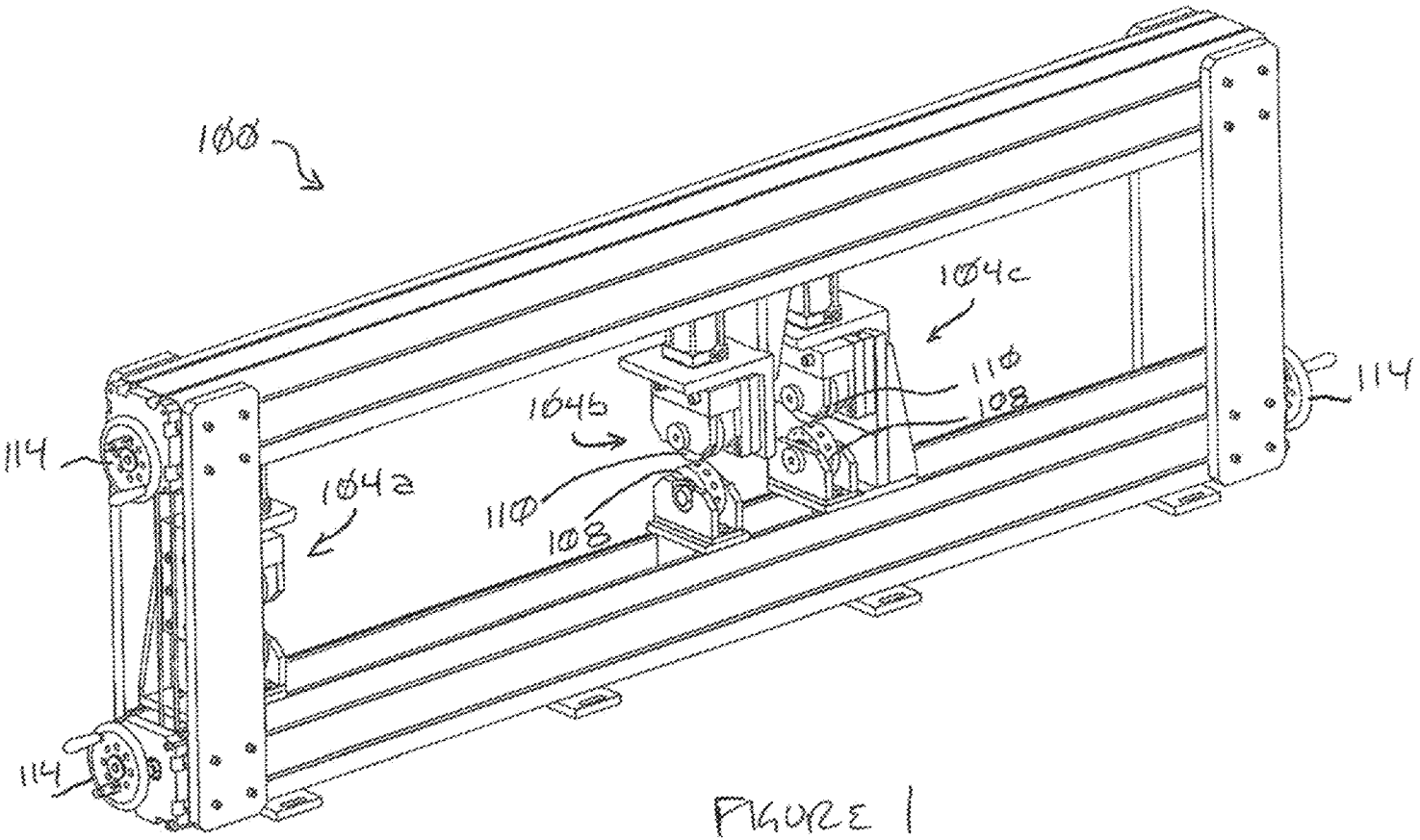
FIG. 1 is a perspective view of an exemplary roll dimpler.
Figure 3:
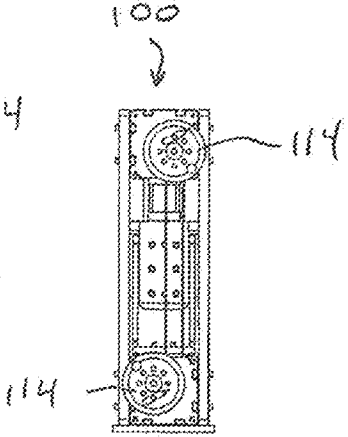
FIG. 3 is a side, plan view of the exemplary roll dimpler of FIG. 1.
Figure 2:
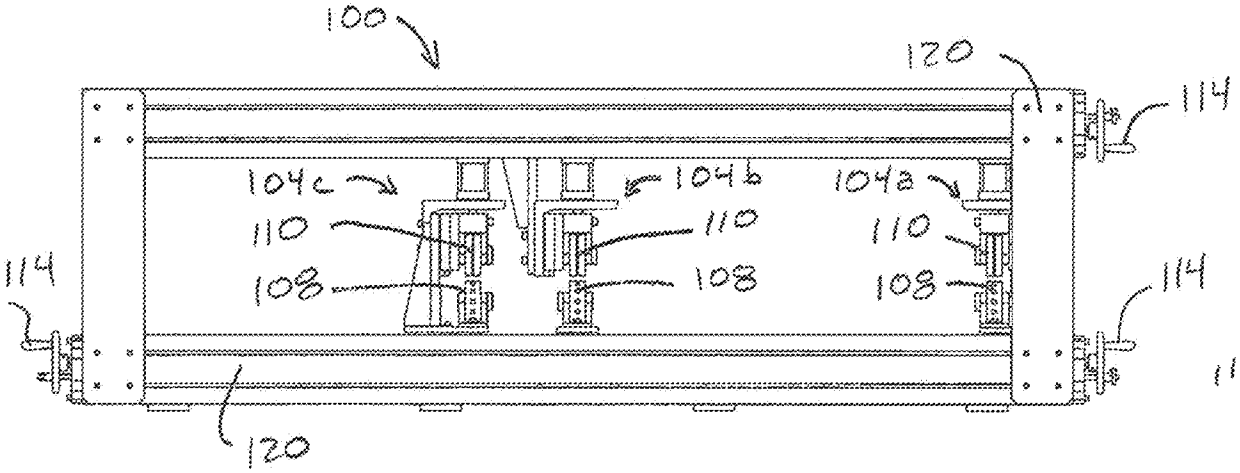
FIG. 2 is a rear, plan view of the exemplary roll dimpler of FIG. 1.
Figure 4:
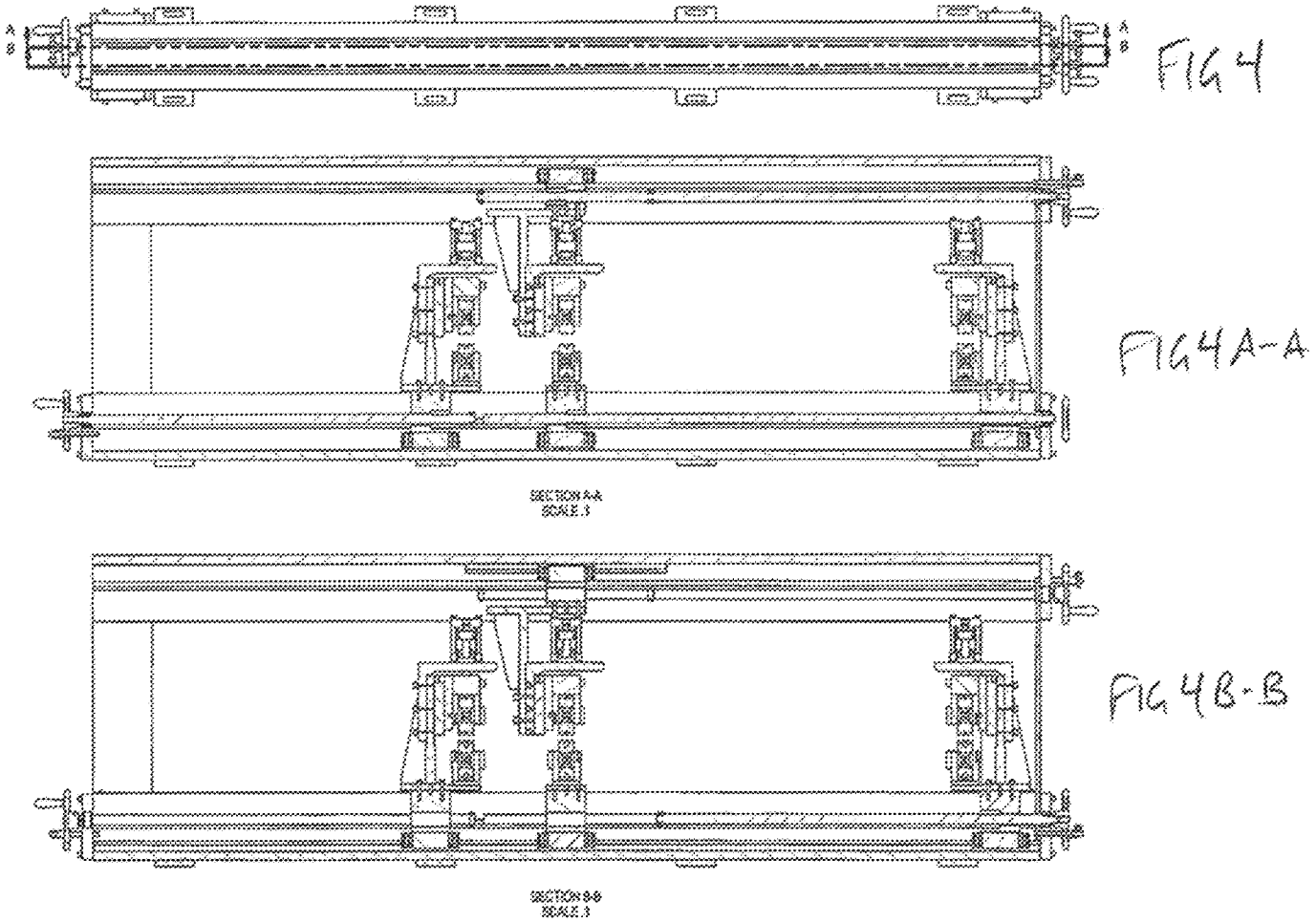
FIGS. 4A-A and 4B-B illustrate cross-sectional views taken along the lines shown in FIG. 4.
Figures 5, 6, 7, 8:
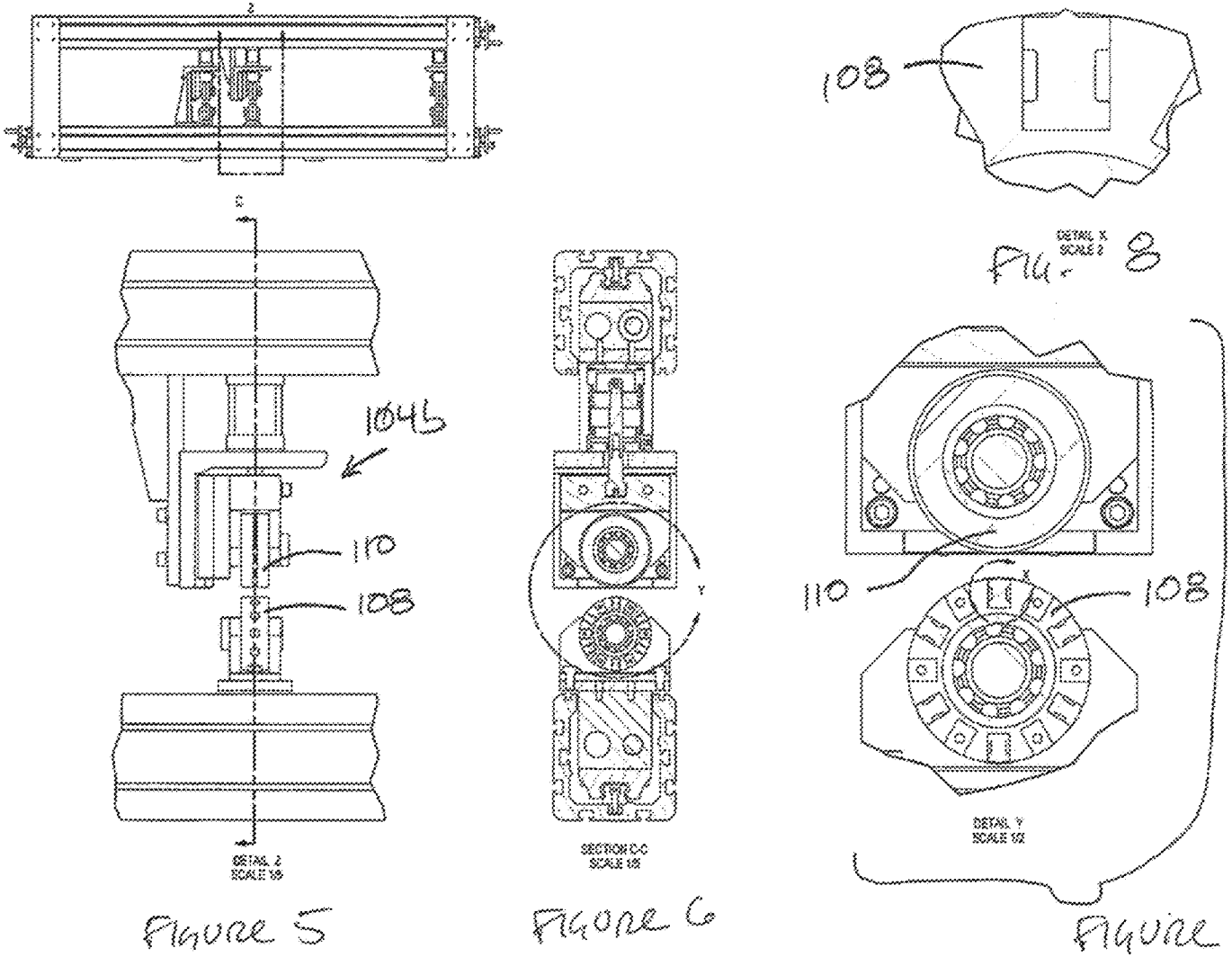
FIG. 5 is an enlarged view of an exemplary dimpling head.
FIG. 6 is a cross-sectional view taken along line C-C in FIG. 5.
FIG. 7 is a further enlarged and partial view illustrating the dimpling wheels.
FIG. 8 is a further enlarged and partial view illustrating the male dimpling wheel insert or punch.

With reference to FIGS. 1-8, an exemplary roll dimpler 100 is shown. The exemplary roll dimpler 100 as shown includes three sets of opposed dimpler head mechanisms 104*a*, 104*b*, 104*c*. Each mechanism 104, in turn comprises a male dimpling roller wheel 108 and an opposed female dimpling roller wheel 110. A compliant pressure source 112 supplies at least one of the male or female dimpling wheel 108, 110. The compliant pressure source 112 provides continuous engagement of both male and female rollers 108, 110 with stock material (not shown) being pushed into the dimpler 100, for example as fed out of a decoiler/straightener (not shown). In an embodiment, the female dimpling wheel 110 acts as a bolster or bed securing the feed stock (not shown) against the male dimpling wheel 108 while the wheels rotate and stamp the dimple into the feed stock. Examples of compliant pressure sources include air cylinders, pneumatic systems, coil or air springs and the like to apply the pressure.

One or more of the dimpler head mechanisms 104 may be adjustable linearly along the device, for example, using adjustment wheels and lead screws 114 or alternately the mechanisms may be positioned manually. The position of the mechanisms 104 in the frame 120 are selected to correspond to the desired location of the dimples on feed stock in use at any particular time. In the illustrated example, each adjustment wheel 114 controls positioning of one mechanism 104.

With reference to FIGS. 9-14 illustrate views of a dimpler mechanism 104 including compliant pressure source 112, male dimpling wheel 108 and female dimpling wheel 110. As illustrated, the compliant pressure source 112 applies pressure to female dimpling wheel 110 where female head 110 acts as a bolster or bed securing the feed stock (not shown) against the male dimpling wheel 108.

Figure 15:
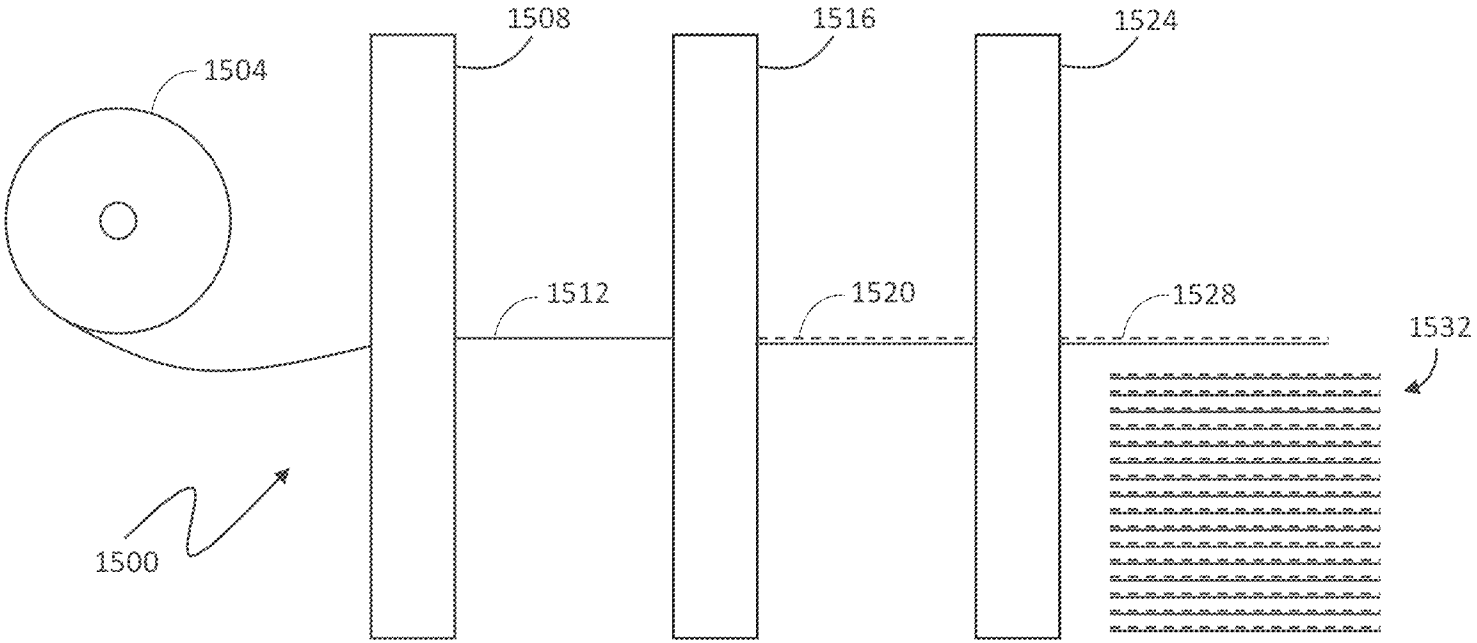
FIG. 15 is a diagram of a metal blank forming system.

With reference to FIG. 15 a simplified system 1500 is illustrated. A roll 1504 of metal stock, for example aluminum, is fed into a decoiler/straightener 1508. Decoiled/straightened stock 1512 is fed out of the decoiler/straightener 1508 into a roll dimpler apparatus 1516. The feed pressure of the decoiled/straightened stock 1512 from the decoiler/straightener 1508 eliminates the need for a separate feed mechanism. As the decoiled/straightened stock 1512 enters the dimpler apparatus 1516, the stock 1512 encounters the dimpler mechanisms 104 (FIGS. 1-8, 10). Compliant pressure source 112 (FIGS. 2, 5, 10) holds opposed dimpler wheels together while the decoiled/straightened stock 1512 is pushed through. Friction of the decoiled/straightened stock 1512 on the dimpler heads 108, 110 (FIGS. 1-8, 10) induces rotation of the wheels. The combination of continuous contact and compliant pressure on the wheels induces rotation of the wheels and produces a dimpled pattern on the stock as it is fed through the dimpler apparatus 1516. We have found that non-compliant hard-shimmed and hydraulic pressure designs to be ineffective. Further, the use of elastomer female dimpler wheels is ineffective. Dimpled stock 1520 is fed out of the dimpler apparatus 1516 into a cutter or blanking press 1524 which produces dimpled, metal blanks 1528 of a determined shape and size. The dimpled, metal blanks 1528 may be fed directly into a stamping press or stacked 1532 for storage, movement or later use.

While the systems, methods, and so on have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on provided herein. Additional advantages and modifications will readily appear to those skilled in the art. Therefore, the invention, in its broader aspects, is not limited to the specific details, the representative apparatus, and illustrative examples. shown and described. Accordingly, departures may be made from such details without departing from the spirit or scope of the applicants' general inventive concept. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

As used herein, "connection" or "connected" means both directly, that is, without other intervening elements or components, and indirectly, that is, with another component or components arranged between the items identified or described as being connected. To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the claims (e.g., A or B) it is intended to mean "A or B or both." When the applicants intend to indicate "only A or B but not both" then the term "only A or B but not both" will be employed. Similarly, when the applicants intend to indicate "one and only one" of A, B or C, the applicants will employ the phrase "one and only one." Thus, use of the term "or" herein is the inclusive, and not the exclusive use. See, Bryan A. Garner, A Dictionary of Modern Legal Usage 624 (2d. Ed. 1995). To the extent that the phrase "one or more of A, B and C" is employed herein, (e.g., a data store configured to store one or more of A, Band C) it is intended to convey the set of possibilities A, B, C, AB, AC, BC, and/or ABC (e.g., the data store may store only A, only B, only C, A&B, A&C, B&C, and/or A&B&C). It is not intended to require one of A, one of B, and one of C. When the applicants intend to indicate "at least one of A, at least one of B, and at least one of C," then the phrasing "at least one of A, at least one of B, and at least one of C" will be employed.

We claim:

1. A method for preparing a sheet of metal for processing into a stack of metal blanks, the method comprising:

adjusting one or more dimpler head mechanisms to a position sufficient to accommodate an expected material thickness of the sheet of metal; and decoiling a roll of metal into the sheet of metal, where the decoiling generates a force urging the sheet of metal through the one or more dimpler head mechanisms, where the dimpler head mechanisms each include a male dimpling wheel and a female dimpling wheel, and, where friction between the male dimpling wheel, the sheet of metal and the female dimpling wheel induces rotation of at least the male dimpling wheel as the sheet of metal passes through the dimpler head mechanisms and forms a repeating dimple pattern in the sheet of metal.

2. The method as set forth in claim 1, further comprising adjusting the one or more dimpler head mechanisms laterally to form the repeating dimple pattern at a desired location on the sheet of metal.

3. The method as set forth in claim 1, further comprising applying a pressure to at least one of the male and female dimpling wheels, pressuring the at least one dimpling wheel toward the other dimpling wheel ensuring contact of at least one of the male and female dimpling wheels with the sheet of metal resulting in turning of the dimpling wheels.

4. The method as set forth in claim 3, where applying the pressure comprises applying a pressure through a guide to the at least one of the male and female dimpling wheels, where the pressure urges the male dimpling wheel and the female dimpling wheel together.

5. The method as set forth in claim 1 where the repeating dimple pattern comprises dimples having a height between 0.001 inches and 0.015 inches.

6. The method as set forth in claim 1 where the repeating dimple pattern comprises dimples having a height between 5 and 15 percent of material thickness.

7. The method as set forth in claim 1 where the repeating dimple pattern comprises dimples spaced between 0.5 inches and 6.0 inches apart.

8. The method as set forth in claim 1 using multiple dimpler head mechanisms.

9. The method as set forth in claim 1, further comprising adjusting at least one dimpler head mechanisms laterally to a separation sufficient to accommodate expected material width of the sheet of metal.

10. The method as set forth in claim 1, further comprising cutting the sheet of metal with the repeating dimple pattern into a dimpled metal blank.

11. The method as set forth in claim 10, further comprising stacking the dimpled metal blank onto other dimpled metal blanks forming a stack of dimpled metal blanks.

12. The method as set forth in claim 11, further comprising suction lifting solely a top dimpled metal blank from the stack of dimpled metal blanks.

13. The method as set forth in claim 12, further comprising inserting the top dimpled metal blank into a stamping press.

14. The method as set forth in claim 13, further comprising stamping the dimpled metal blank into a desired form and trimming a portion of the dimpled metal blank bearing the repeating dimple pattern from the desired form.

15. The method as set forth in claim 13, further comprising stamping the dimpled metal blank into a desired form where the stamping removes some or none of the repeating dimple pattern from the desired form.

16. A method comprising:

providing a frame comprising at least one dimpler head mechanisms, where the at least one dimpler head mechanism includes a male dimpling wheel and a female dimpling wheel;

adjusting the male dimpling wheel and the female dimpling wheel to accommodate an expected material thickness of a sheet of metal;

adjusting the at least one dimpler head mechanism laterally within the frame to provide a repeating dimple pattern at a desired location on the expected sheet of metal;

urging the sheet of metal between the at least one dimpler head mechanism, where friction between the male dimpling wheel, the sheet of metal and the female dimpling wheel induces rotation of at least the male dimpling wheel as the sheet of metal passes through the dimpler head mechanisms and a repeating dimple pattern of dimples having a height between 0.001 inches and 0.015 inches is formed in the sheet of metal.

17. The method as set forth in claim 16, further comprising:

stacking the sheet of metal with the repeating dimple pattern onto other sheets of metal with a repeating dimple pattern forming a stack of dimpled sheets of metal; and suction lifting solely a top dimpled sheet of metal from the stack.

18. A method comprising:

providing a frame comprising at least one dimpler head mechanisms, where the at least one dimpler head mechanism includes a male dimpling wheel and a female dimpling wheel;

adjusting the male dimpling wheel and the female dimpling wheel to accommodate an expected material thickness of a sheet of metal;

adjusting the at least one dimpler head mechanism laterally within the frame to provide a repeating dimple pattern at a desired location on the expected sheet of metal;

urging the sheet of metal between the at least one dimpler head mechanism, where friction between the male dimpling wheel, the sheet of metal and the female dimpling wheel induces rotation of at least the male dimpling wheel as the sheet of metal passes through the dimpler head mechanisms and a repeating dimple pattern is formed in the sheet of metal; and stacking the sheet of metal with the repeating dimple pattern onto other sheets of metal with a repeating dimple pattern forming a stack of dimpled sheets of metal; and suction lifting solely a top dimpled sheet of metal from the stack.

19. The method as set forth in claim 18, where the repeating dimple pattern comprises dimples having a height between 0.001 inches and 0.015 inches.

20. The method as set forth in claim 18, further comprising inserting the top dimpled sheet of metal into a stamping press.

* * * * *